United States Patent [19]

Sakurai et al.

[11] Patent Number: 4,806,277

[45] Date of Patent: Feb. 21, 1989

[54] DECONTAMINATING SOLID SURFACES

[75] Inventors: Mikio Sakurai, Mito; Tsutomu Hayashi, Hitachi; Masayuki Izumi, Hitachi; Hiroshi Sasaki, Hitachi; Thoru Satho, Hitachi; Kazuo Owada, Hitachi, all of Japan

[73] Assignees: Hitachi Ltd.; Hitachi Engineering Co., Ltd., both of Tokyo, Japan

[21] Appl. No.: 49,942

[22] Filed: May 15, 1987

[30] Foreign Application Priority Data

May 19, 1986 [JP] Japan ..... 61-112628

[51] Int. Cl.[4] ..... G21F 9/00; B08B 3/12; B08B 9/00

[52] U.S. Cl. ..... 252/626; 15/1; 134/1; 134/22.1; 134/22.11; 134/22.12; 134/37; 134/184; 376/310

[58] Field of Search ..... 252/626, 627; 134/2, 134/3, 1, 22.1, 22.12, 22.13, 22.11, 31, 37, 18, 184; 376/316, 310, 308; 165/95; 15/1; 175/67; 114/222; 299/14, 17

[56] References Cited

U.S. PATENT DOCUMENTS

| | | | |
|---|---|---|---|
| 3,105,779 | 10/1963 | Bulat | 134/1 |
| 3,139,101 | 6/1964 | Wyczalek et al. | 134/1 |
| 3,373,752 | 3/1968 | Inoue | 134/1 |
| 3,713,699 | 1/1973 | Johnson, Jr. | 134/1 |
| 3,947,567 | 3/1976 | Berg, Jr. et al. | 426/590 |
| 4,194,922 | 3/1980 | Gransell et al. | 134/184 |
| 4,244,749 | 1/1981 | Sachs et al. | 134/1 |
| 4,699,665 | 10/1987 | Scharton et al. | 376/316 |

FOREIGN PATENT DOCUMENTS 55-104799 11/1980 Japan .

*Primary Examiner*—Howard J. Locker
*Attorney, Agent, or Firm*—Antonelli, Terry & Wands

[57] ABSTRACT

The present invention relates to a decontamination method in which an object to be decontaminated is immersed in a liquid, bubbles are produced by blowing vapor in the liquid, and these bubbles are caused to burst on a solid surface which constitutes the object to be decontaminated which is brought into contact with the liquid, whereby substances adhered to the solid surface are separated and removed by the impulsive force produced when the bubbles burst. Also provided is a method of decontaminating solid surfaces which exhibits a high degree of efficiency and a high level of safety.

8 Claims, 2 Drawing Sheets

DECONTAMINATING SOLID SURFACES

BACKGROUND OF THE INVENTION

The present invention relates to a method of decontaminating solid surfaces, and particularly to a method of decontamination which is suitable for the purpose of decontaminating solid surfaces as a measure designed to reduce the potential danger of personnel being exposed to radioactive substances in nuclear installations.

DESCRIPTION OF THE PRIOR ART

A method of decontaminating solid surfaces in which bubbles are produced in a liquid and the impulsive forces produced when the bubbles burst are employed for separating and removing substances adhered to the solid surfaces has certain advantages in that it is also suitable for the decontamination of articles having complicated forms, produces only a small amount of secondary waste solution, and does not necessitate any use of chemicals, and it has thus recently attracted attention. This method includes ultrasonic washing methods such as the one disclosed in Japanese Unexamined Patent Publication No. 104799/1980. This method utilizes pressure vibrations in a liquid caused by ultrasonic waves whereby bubbles are repeatedly generated and allowed to burst in the liquid. This method is thus able to remove so-called soft clads such as substances that have adhered to the outer layer of a solid surface but has not been able to remove so-called hard clads such as oxide films in the depths of the object to be decontaminated. In addition, since the ultrasonic decontamination apparatus used in practice comprises an ultrasonic generator, a piezoelectric transducer, and a cleaning bath and since it utilizes a method in which an object to be decontaminated is decontaminated while being immersed in a liquid in the cleaning bath, it has been impossible to decontaminate piping or instruments in the state in which they are installed.

SUMMARY OF THE INVENTION

It is an object of the present invention to provide a method of decontamination which overcomes the disadvantages of the above-described conventional method of decontaminating solid surfaces by means of ultrasonic waves and which is capable of effectively removing hard clads and other substances even in the state wherein piping and instruments are fixed in position.

The present invention is characterized by comprising the steps of immersing an object to be decontaminated in a liquid, producing bubbles in the liquid by blowing vapor therein, and causing the bubbles to burst on a solid surface which is brought into contact with the liquid and which constitutes the object to be decontaminated so that substances adhered to the solid surface are separated and removed therefrom by the impulsive force produced when the bubbles burst.

The present invention can produce bubbles which are extremely large in comparison with those formed by an ultrasonic washing method, and the method of the invention employs vapor and thus is capable of obtaining a greater impulsive force, whereby an excellent decontamination effect can be obtained.

The function and effect of the decontamination method of the present invention is described in detail below.

(1) Effect of decontamination

The present invention is similar to the abovedescribed ultrasonic washing method in that both involve the production of bubbles in a liquid and deal with decontamination by utilizing the impulsive force produced when the bubbles burst. In the present invention, however, it is possible to produce bubbles having a larger diameter than those of the ultrasonic washing method by directly injecting vapor in the liquid and the impulsive force produced is proportional to the third power of the initial diameter of the bubbles, whereby an impulsive force which is greater than that obtainable by the ultrasonic washing method can be achieved. Therefore, not only soft clads that are adhered to the surface in the outer layer thereof but also hard clads in the depths can be removed.

(2) Soundness after decontamination

Since the present invention uses no decontaminating agent or abrasive, no agent remains after decontamination and no adverse effect upon the soundness of piping or instruments is suffered.

(3) Reduction of the amount of waste solution

In the method of decontaminating solid surfaces in accordance with the present invention, the amount of secondary waste solution produced following the decontamination work is equal to the amount of vapor injected as the source of generation of bubbles, but the volume of the vapor is reduced to about 1/1500 when condensed and the amount of waste solution to be dealt with is thus kept to a small amount.

(4) Workability

The present invention uses only vapor and thus exhibits a very high level of safety in comparison with conventional methods of decontamination that use specific chemicals and high-pressure water. In addition, the invention generates no dust during the decontamination work and thus allows a working environment to be kept under sanitary conditions.

(5) Applicable field

Since the present invention employs the impulsive force produced when bubbles burst, it is possible to decontaminate a surface having a complicated form. In addition, since the method of decontamination utilizes only the injection of vapor, it is possible to decontaminate the inside of piping or an instrument while installed in situ.

(6) Prevention of the spread of contamination

In the present invention, since all the operations of decontamination are conducted in a liquid and the pressure of the vapor to be injected may be low, there is no possibility of the contamination being spread due to splashed water.

DESCRIPTION OF THE PREFERRED EMBODIMENTS

Embodiment 1

Figure 1A:
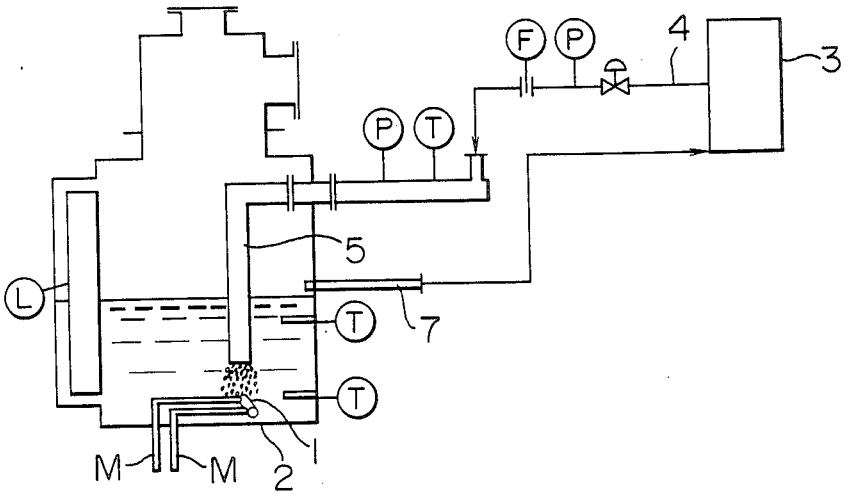
FIGS. 1*a*, 1*b*, 2, and 3 are schematic sectional views showing the apparatus for decontamination used in embodiments of the present invention.
Figure 1B:
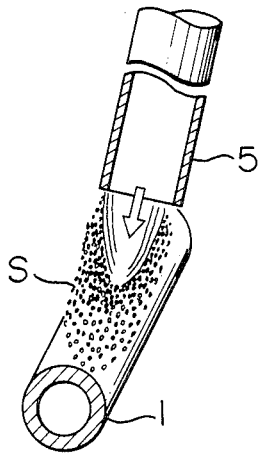

An embodiment of the present invention is first described with reference to FIGS. 1*a* and 1*b*. In this embodiment, a copper tube 1 to be decontaminated was placed in a water bath 2 and steam blown out from vapor nozzles 5 having an inner diameter of 20A was condensed on the surface of the copper tube 1 so as to decontaminate it. The water bath 2 was filled with a water of 60° C. in temperature and the steam of 100° C. in temperature blown out from the vapor nozzles 5 was condensed by being cooled with the water. The steam was supplied with a pressure of 10 kgf/cm$^2$ to the vapor nozzles 5 from a vapor supplier 3 via vapor supply piping 4. Since the temperature of the copper tube in the water bath 2 rose when the steam blown out was applied, a cooling liquid was introduced in the copper tube 1 through pipings (M) connected thereto. The steam was jetted from the nozzle 5 with a constant rate of 130 kg/h. In FIG. 1*a*, "L" indicates a level gauge, "T" being a thermometer, "P" being a pressure gauge, and "F" being a flow meter. FIG. 1*b* shows a state of steam (S) applied onto the tube 1 to be decontaminated. In addition, since the steam condensed on the surface of the object 1 to be decontaminated became condensed water which raised the level of the liquid in the water bath 2, an amount of liquid corresponding to this rise in level was expelled through an overflow pipe 7.

As a result of the decontaminating, it was confirmed that the removal of the surface layer of 38 mg was achieved by the jetting of the steam applied for seven days.

This embodiment was also capable of decontaminating a body having complicated surfaces by use of a simple apparatus and of decontaminating hard clads which could not be effectively removed by means of the conventional ultrasonic washing method.

Embodiment 2

Figure 2:
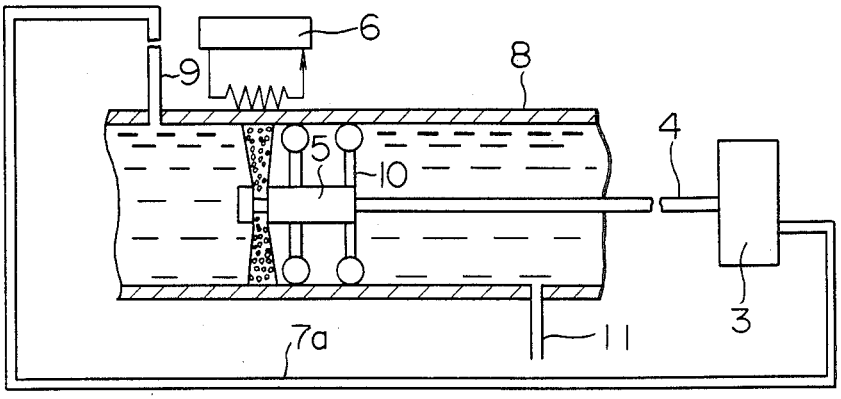

Another embodiment of the present invention is shown in FIG. 2. In this embodiment, a movable vapor nozzle 5 was moved in piping 8 in order to decontaminate the inside of the piping 8. The vapor nozzle 5 was supported in the piping 8 by supporting means 10 so that the position of the vapor nozzle 5 was suitably maintained and can be moved in the piping 8. The steam having the same conditions as in Embodiment 1 was supplied to the vapor nozzle 5 from a vapor supplier 3 via vapor supply piping 4 which made use of a flexible tube in order to ensure that the steam is properly supplied if the piping 8 is bent along its length. Since the steam condensed on the inside of the piping 8 became condensed water which increased the amount of water in the piping 8, surplus water was expelled through a vent pipe 9. In addition, since the temperature of the liquid in the piping 8 rose when the steam blown out was condensed, the outside of the piping 8 was cooled by a cooling apparatus 6 or the rise in the temperature of the water in the piping 8 was controlled to be a temperature not more than saturation temperature by continuously supplying cooling water from a drain pipe 11. In addition, since the vapor nozzle 5 was simply inserted in the piping 8, the piping did not need to be detached contrary to the case of the ultrasonic washing method, and could thus be decontaminated in situ. Furthermore, the decontaminating work could be conducted extremely simply and efficiently.

Embodiment 3

Figure 3:
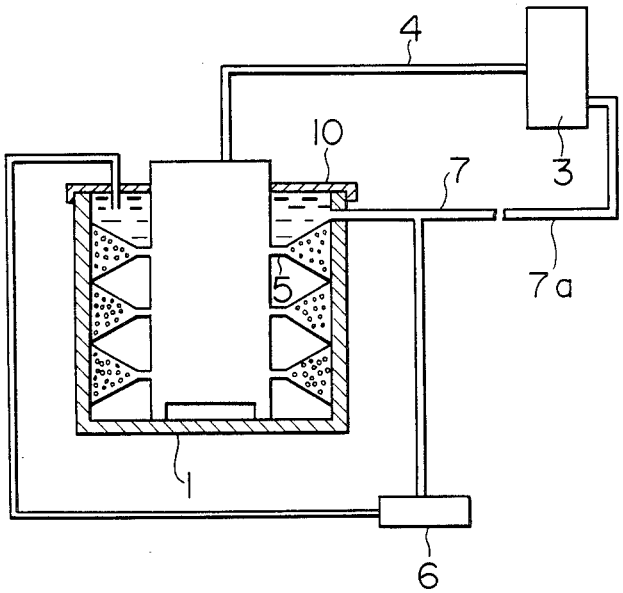

A further embodiment of the present invention is shown in FIG. 3. This embodiment concerns decontamination of the inside of a bath 1 which is an object to be decontaminated by vapor nozzles 5 provided in the bath 1. The vapor nozzles 5 had an arrangement and a structure both of which correspond to the shape of the inside of the bath 1 to be decontaminated so as to supply steam to the inside of the bath 1 with an appropriate distribution pattern. The steam having the same conditions as the Embodiment 1 was supplied to the vapor nozzles 5 from a vapor supplier 3 via vapor supply piping 4 and was blown out therefrom. Since the steam condensed on the inside of the bath 1 became condensed water which increased the level of the water in the bath 1, surplus water was expelled through an overflow pipe 7. In addition, since the temperature of the water in the bath 1 rose when the steam blown out was condensed, part of the surplus water was guided to a cooling apparatus 6, was cooled, and was then returned to the bath 1, whereby the temperature of the water in the bath 1 was controlled to be a temperature not more than the saturation temperature. In this embodiment, in order to control the vibrations of the vapor nozzles 5, the vapor nozzles 5 were preferally fixed to the bath 1 by a supporting means 10.

In the embodiment of the present invention shown in FIG. 1, it is possible to recover the washing water remaining after condensation and to recycle it. In other words, if the washing water is reused after being returned to the vapor supplier 3 by recovery piping 7 which extends from the overflow pipe 7 and is again vaporized, the amount of secondary waste solution produced following the decontamination can be reduced. Of course, the washing water remaining after condensation can be returned to the vapor supplier 3 from the vent pipe 9 shown in FIG. 2 or from the overflow pipe 7 shown in FIG. 3 by way of recovery piping 7*a*.

In the present invention, an organic solvent may, for example, be used as the liquid in which the object to be decontaminated is placed.

In addition, the above-described liqid becomes more effective if it is kept at a lower temperature. It is particularly preferable to cool the liquid to its saturation temperature or less because the vapor will then easily condense on a solid surface.

EFFECT OF THE INVENTION

In accordance with the present invention, the following effects are obtained:

(1) Hard clads in the depths of an object to be decontaminated can be removed. In particular, in a nuclear installation, since the greater part of a radiation source is contained in these hard clads, their removal can greatly reduce the amount of exposure to which personnel are subjected during work tasks.

(2) The soundness of piping and instruments is not impaired after decontamination.

(3) The amount of secondary waste solution produced following the decontamination work is very small and it can be reduced to an extremely small amount, depending upon the manner of the operation of the method employed.

(4) The safety level during decontamination work is high and a sanitary working environment can be maintained.

(5) A body having a complicated surface form can be decontaminated and the inside of piping and instruments can be decontaminated in situ.

(6) It is possible to suppress the spread of radioactive contamination following the decontamination work.

What is claimed is:

1. A method of decontaminating solid surfaces which are contaminated by substances including radioactive materials, comprising the steps of immersing an object to be decontaminated in a liquid, maintaining said liquid at its saturation temperature or less, producing bubbles in said liquid by blowing vapor therein, and causing said bubbles to burst on a solid surface which is brought into contact with said liquid and which constitutes said object to be decontaminated so that substances adhered to said solid surface are separated and removed by means of an impulsive force produced when said bubbles burst.

2. A method of decontaminating solid surfaces according to claim 1, wherein said vapor is the vapor of a substance which is the same as said liquid.

3. A method of decontaminating solid surfaces according to claim 1, wherein said solid surface is a copper tube.

4. A method of decontaminating solid surfaces according to claim 1, wherein said solid surface is an inside surface of piping.

5. A method of decontaminating solid surfaces according to claim 1, wherein said solid surface is an inside surface of a bath.

6. A method of decontaminating solid surfaces according to claim 1, wherein said substances are soft and hard clads.

7. A method of decontaminating solid surfaces accoding to claim 1, wherein said hard clads are oxide films.

8. A method of decontaminating solid surfaces according to claim 1, wherein said solid surface remains in an installed condition during decontamination.

* * * * *